US010744629B2

(12) United States Patent
Ishizawa

(10) Patent No.: US 10,744,629 B2
(45) Date of Patent: Aug. 18, 2020

(54) FASTENER DRIVING TOOL

(71) Applicant: HITACHI KOKI CO., LTD., Tokyo (JP)

(72) Inventor: Yoshinori Ishizawa, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 585 days.

(21) Appl. No.: 15/323,268

(22) PCT Filed: Jun. 19, 2015

(86) PCT No.: PCT/JP2015/067723
§ 371 (c)(1),
(2) Date: Mar. 31, 2017

(87) PCT Pub. No.: WO2016/002540
PCT Pub. Date: Jan. 7, 2016

(65) Prior Publication Data

US 2017/0274512 A1 Sep. 28, 2017

(30) Foreign Application Priority Data

Jun. 30, 2014 (JP) ..... 2014-135310

(51) Int. Cl.
*B25C 1/00* (2006.01)
*B25C 7/00* (2006.01)
*B25C 1/04* (2006.01)

(52) U.S. Cl.
CPC ..... *B25C 1/008* (2013.01); *B25C 1/04* (2013.01); *B25C 1/043* (2013.01); *B25C 1/047* (2013.01); *B25C 7/00* (2013.01)

(58) Field of Classification Search
CPC ..... B25C 1/008; B25C 1/04; B25C 1/043
(Continued)

(56) References Cited

U.S. PATENT DOCUMENTS 5,193,730 A 3/1993 Tanaka et al.
7,677,426 B2 * 3/2010 Tillinghast ..... B25C 1/043 227/130

(Continued)

FOREIGN PATENT DOCUMENTS

EP 1 231 030 A2 8/2002
JP 61-117680 U 7/1986

(Continued)

OTHER PUBLICATIONS

Machine Translation of JP-09225855-A, 2019.*

(Continued)

*Primary Examiner* — Hemant Desai
*Assistant Examiner* — Veronica Martin
(74) *Attorney, Agent, or Firm* — McDermott Will & Emery LLP

(57) ABSTRACT

A fastener driving tool is provided which performs driving only when a trigger lever is turned ON following a push lever. The fastener driving tool includes a sleeve valve driving a driver blade, and in the sleeve valve, supply and exhaust of compressed air are controlled by a trigger valve. The trigger valve includes a valve piston movable between an air-supply position where the valve piston causes an opening part and a communication port to communicate with each other and blocks an exhaust port, and an exhaust position where the valve piston blocks the opening part and causes the exhaust port and the communication port to communicate with each other, and a plunger movable between a communication position where the plunger causes compressed air in a pressure accumulation chamber to be supplied to a pressure chamber and a shutoff position where the plunger shuts off communication between the pressure accumulation chamber and the pressure chamber and causes air in the pressure chamber to be exhausted. When a trigger (Continued)

and a push lever are in striking stop positions, the plunger is driven to a communication position by a trigger arm.

6 Claims, 17 Drawing Sheets

(58) Field of Classification Search
USPC ..... 227/8
See application file for complete search history.

(56) References Cited

U.S. PATENT DOCUMENTS

| | | | | |
|---|---|---|---|---|
| 8,162,195 | B2 * | 4/2012 | Wu | B25C 1/047 227/130 |
| 2007/0278275 | A1 * | 12/2007 | Ho | B25C 1/008 227/8 |
| 2009/0302087 | A1 * | 12/2009 | Liang | B25C 1/008 227/130 |
| 2010/0301091 | A1 * | 12/2010 | Liang | B25C 1/008 227/8 |
| 2011/0114692 | A1 * | 5/2011 | Liang | B25C 1/04 227/2 |
| 2011/0266327 | A1 | 11/2011 | Wu | |
| 2012/0037682 | A1 * | 2/2012 | Ho | B25C 1/008 227/8 |
| 2012/0074194 | A1 * | 3/2012 | Miller | B25C 1/008 227/8 |
| 2012/0298712 | A1 * | 11/2012 | Ishizawa | B25C 1/008 227/8 |
| 2016/0114470 | A1 * | 4/2016 | Weigmann | B25C 1/047 227/8 |

FOREIGN PATENT DOCUMENTS

| | | | | |
|---|---|---|---|---|
| JP | 3-59173 | U | | 6/1991 |
| JP | 4-372377 | A | | 12/1992 |
| JP | 5-53873 | U | | 7/1993 |
| JP | 9-225855 | A | | 9/1997 |
| JP | 09225855 | A | * | 9/1997 |
| JP | 2005-205524 | A | | 8/2005 |
| JP | 3740817 | B2 | | 2/2006 |
| JP | 2007-075957 | A | | 3/2007 |
| JP | 2008-149404 | A | | 7/2008 |
| JP | 5286939 | B2 | | 9/2013 |
| WO | 2013/145685 | A1 | | 10/2013 |

OTHER PUBLICATIONS

International Search Report issued in International Application No. PCT/JP2015/067723, dated Aug. 25, 2015, with English Translation.

Extended European Search Report issued in corresponding EP Patent Application No. 15815724.8, dated Feb. 9, 2018.

* cited by examiner

41: TRIGGER
44: PUSH LEVER
51: TRIGGER VALVE
54: OPENING PART
55: EXHAUST PORT
61: VALVE PISTON
66: PRESSURE CHAMBER
67: PLUNGER
76: TRIGGER ARM

FASTENER DRIVING TOOL

CROSS-REFERENCE TO RELATED APPLICATIONS

This application is the U.S. National Phase under 35 US.C. § 371 of International application No. PCT/JP2015/067723, filed on Jun. 19, 2015, which claims the benefit of Japanese Application No. 2014-135310, filed on Jun. 30, 2014, the entire contents of each are hereby incorporated by reference.

TECHNICAL FIELD

The present invention relates to a fastener driving tool for driving a fastener such as a nail or a staple into a workpiece by driving a piston by compressed air.

BACKGROUND ART

A fastener driving tool using compressed air as a driving medium includes a piston provided with a driver blade striking a fastener, and a cylinder accommodating the piston such that the piston can freely reciprocate. When compressed air is supplied to a drive chamber partitioned by the cylinder and the piston, the piston is driven in a striking direction, and the fastener is struck by the driver blade. The cylinder is provided with a sleeve valve switching the state between a state of supplying compressed air to the drive chamber and a state of stopping supply of compressed air and exhausting the compressed air in the drive chamber.

The fastener driving tool includes a push lever and a trigger. When a push member provided at a tip of the fastener driving tool is pressed against a workpiece, the push lever is driven from a striking stop position, that is, an OFF position, to a striking enabling position, that is, an ON position, and the trigger is operated from a striking stop position to a striking enabling position when a worker pulls the trigger. The fastener driving tool is provided with a trigger valve in order to control actuation of the sleeve valve according to drive of the push lever and the operation of the trigger.

As described in Patent Documents 1 and 2, there are so-called continuous driving and single driving as fastener driving modes performed by a fastener driving tool including a push lever and a trigger. In addition, Patent Document 3 describes a fastener driving tool whose specification can be changed to either the specification for the continuous driving or the specification for the single driving by replacing the trigger.

A continuous driving mode is a driving mode in which a piston is driven in a striking direction when the trigger is operated from the striking stop position to the striking enabling position by a worker, the push member at the tip of the fastener driving tool is pressed against a workpiece by the worker, and the push lever is driven to the ON position, that is, the striking enabling position. When at least one of the push lever and the trigger is returned to the striking stop position, the piston comes back to a backward position. Thus, in a case where the trigger is pulled in a state in which the tip of the fastener driving tool is brought into contact with the workpiece or a switching operation between ON and OFF of the push lever is performed in a state in which the trigger is being pulled, the piston is driven in the striking direction, and fasteners can be continuously driven into the workpiece.

In contrast, the conventional single driving is a striking system in which, when the trigger is pulled after the push lever is lifted up and driven to the striking enabling position, the piston is driven in the striking direction, and a fastener is struck. In this single driving, when an ON-OFF operation of the trigger is repeated while keeping a state in which the fastener driving tool is pressed against the workpiece (state in which the push lever is turned ON), the piston reciprocates, and a fastener driving mode can be performed.

RELATED ART DOCUMENTS

Patent Documents

Patent Document 1: Japanese Patent No. 5286939
Patent Document 2: Japanese Patent No. 3740817
Patent Document 3: Japanese Patent Application Laid-Open Publication No. 2008-149404

SUMMARY OF THE INVENTION

Problems to be Solved by the Invention

An object of the present invention is to provide a fastener driving tool with a simple structure, the fastener driving tool adopting, as a new driving system instead of the above driving systems, a single driving system, so-called a full sequential trigger system, in which a second fastener can be driven in a case where a driving operation is performed by pulling a trigger after a push-lever lifting operation is performed, both of the push lever and the trigger are returned to initial positions, and then, the push lever and the trigger are sequentially operated again.

Means for Solving the Problems

A fastener driving tool according to the present invention includes: a cylinder to which a main piston including a driver blade is mounted such that the main piston can axially reciprocate; and a sleeve valve driven between a position where compressed air in a pressure accumulation chamber is supplied to the main piston and a position where supply of the compressed air is stopped, by the compressed air supplied to a valve drive chamber, and the fastener driving tool further includes: a piston case provided with an opening part communicating with the pressure accumulation chamber, an exhaust port communicating with outside, and a communication port communicating with the valve drive chamber; a hollow valve piston mounted in the piston case so as to be movable between an air-supply position where the valve piston causes the opening part and the communication port to communicate with each other and blocks the exhaust port, and an exhaust position where the valve piston blocks the opening part and causes the exhaust port and the communication port to communicate with each other; a sliding piston part provided at the valve piston and partitioning a pressure chamber in the piston case, the pressure chamber applying a thrust force in a direction toward the air-supply position to the valve piston; a plunger mounted to the valve piston so as to be movable between a communication position where the compressed air in the pressure accumulation chamber is supplied to the pressure chamber, and a shutoff position where communication between the pressure accumulation chamber and the pressure chamber is shut off and air in the pressure chamber is exhausted; a trigger operated between a striking enabling position and a striking stop position; a push lever brought into contact with a workpiece and driven to a striking enabling position, and driven to a striking stop position when the push lever separates from the workpiece; and a trigger arm swingably mounted to the trigger and driving the plunger to the communication position when the trigger and the push lever are in the striking stop positions. When the trigger is operated to the striking enabling position after the push lever is operated to the striking enabling position under a state in which the valve piston is in the air-supply position, the valve piston is driven to the exhaust position and the driver blade is driven.

Effects of the Invention

When the trigger and the push lever are in the striking stop positions, the plunger is in the communication position, the valve piston is in the air-supply position, compressed air in the pressure accumulation chamber is supplied to the sleeve valve, and the driver blade is in a backward limit position. In a state in which the valve piston is in the air-supply position, when the trigger is operated to a striking position after the push lever is operated to a striking position, the valve piston is driven to the exhaust position, and the driver blade is struck. The fastener driving tool according to the present invention can realize a configuration for driving a fastener only in a driving mode satisfying the above condition without greatly changing the basic structure of a trigger valve.

BRIEF DESCRIPTIONS OF THE DRAWINGS

Figure 15:
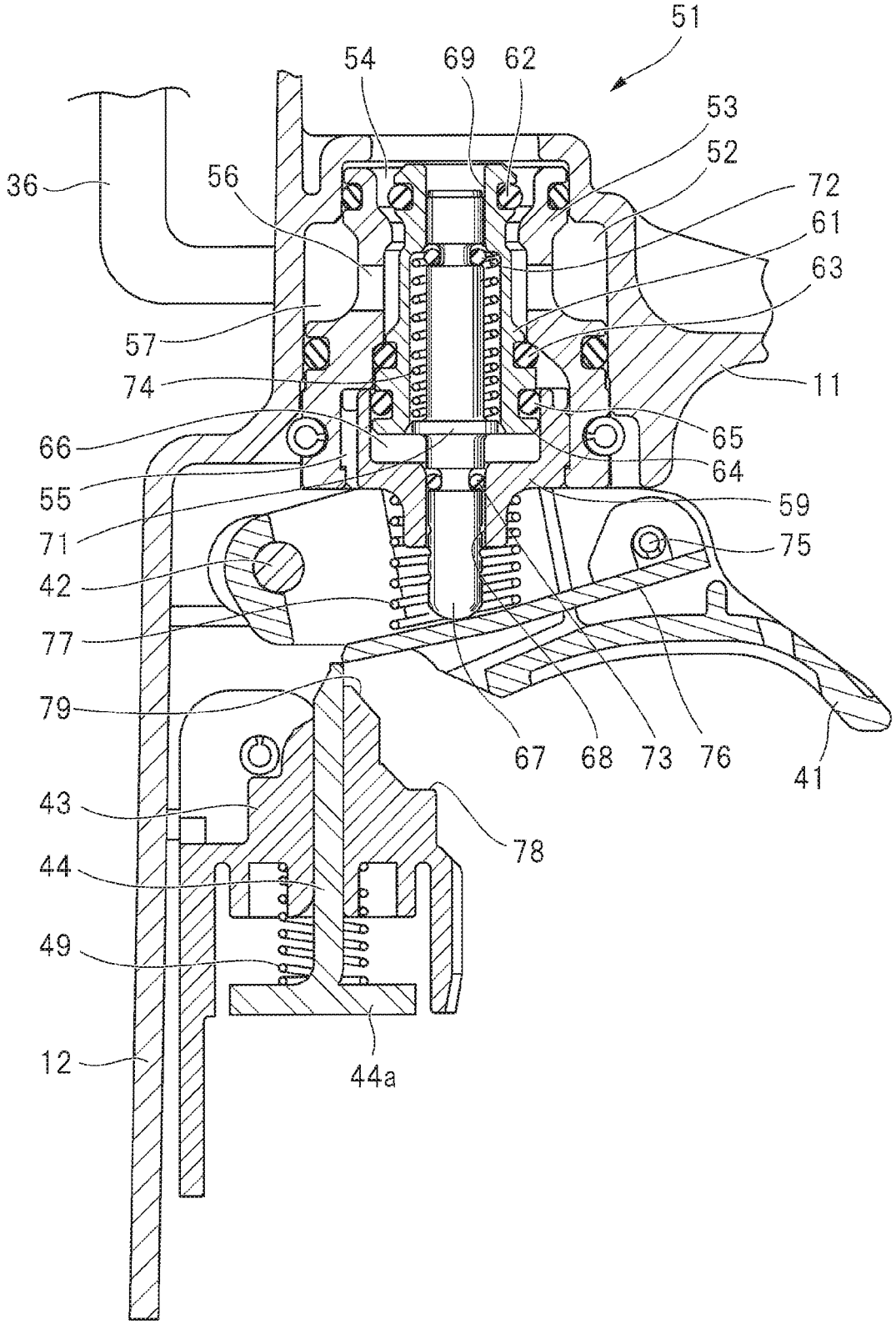
FIG. 15 is a cross-sectional view illustrating the actuation state of the trigger valve when the push lever is being driven toward the striking stop position after the fastener is struck as illustrated in FIG. 5.
Figure 16:
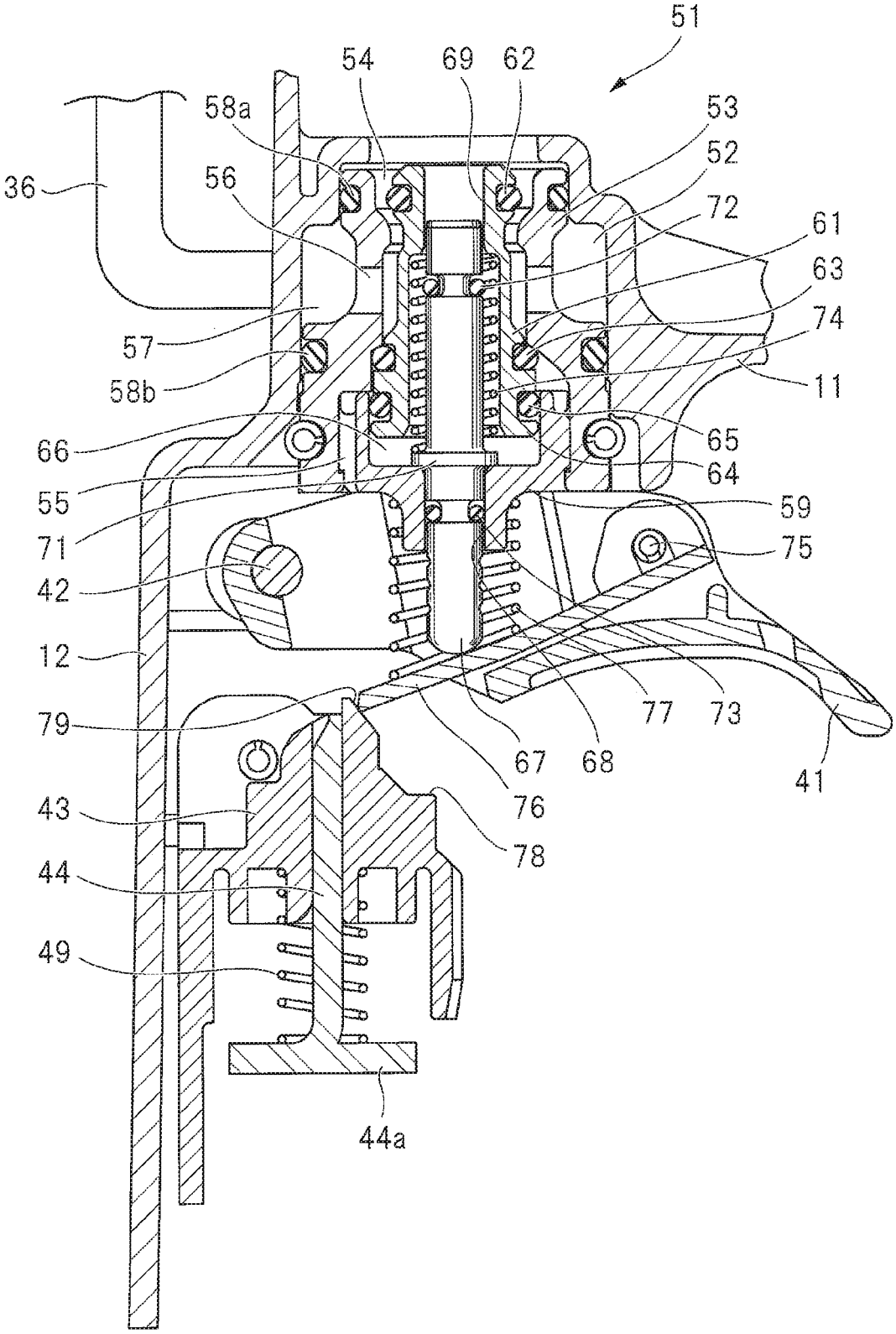
Figure 17:
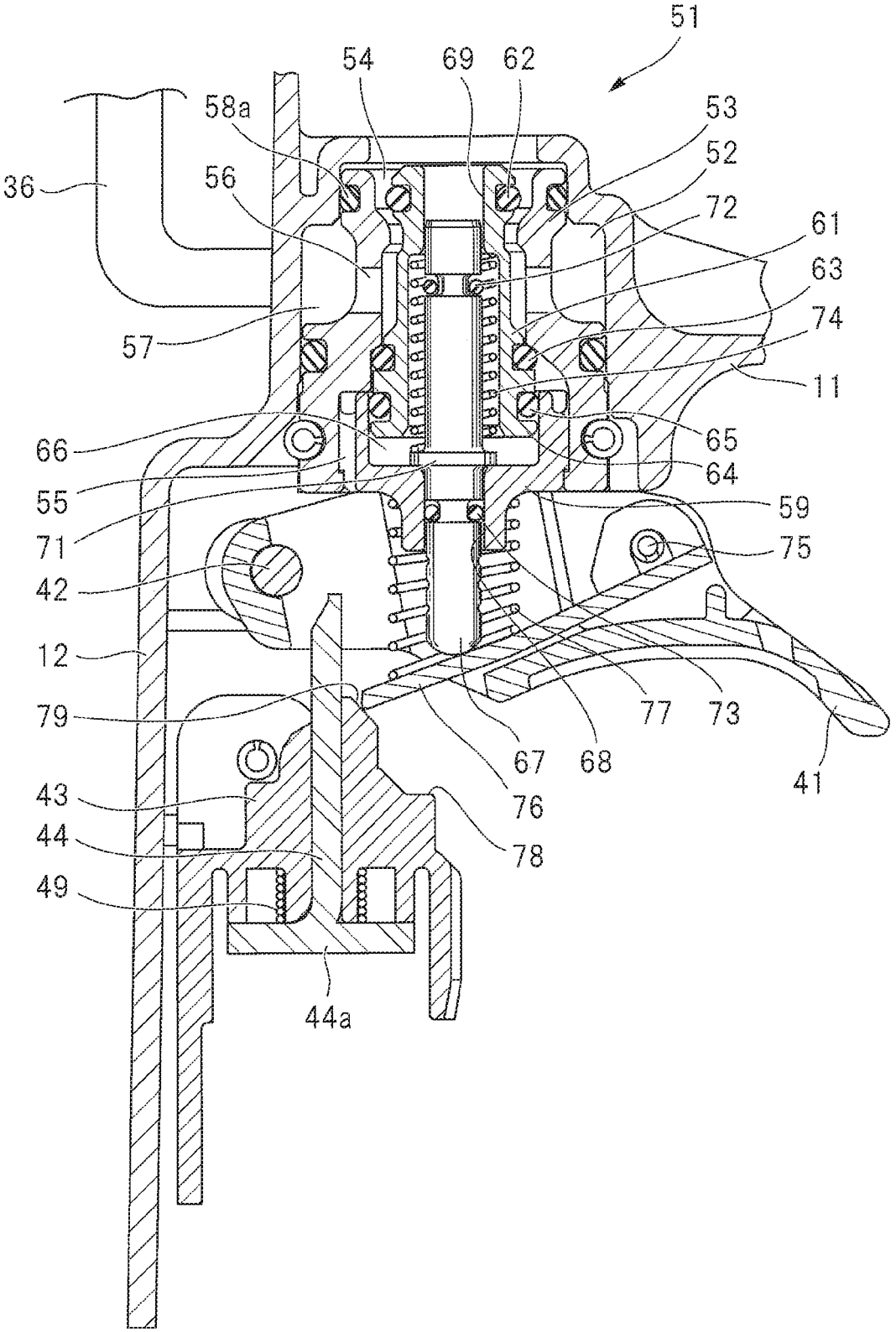

FIG. 16 is a cross-sectional view illustrating the actuation state of the trigger valve when the push lever is driven to the striking stop position from the state illustrated in FIG. 15; and FIG. 17 is a cross-sectional view illustrating the actuation state of the trigger valve when the push lever is driven from the striking stop position to the striking enabling position under the state in FIG. 16.

DETAILED DESCRIPTION OF PREFERRED EMBODIMENTS

Hereinafter, an embodiment of the present invention will be described in detail according to the drawings.

As illustrated in FIGS. 1 to 4, a fastener driving tool 10 includes a main case 12 provided with a handle 11 gripped by a worker, and a cylinder 13 is incorporated in the main case 12. In the cylinder 13, a main piston 14 is mounted so as to be capable of axially reciprocating, and the main piston 14 is provided with a driver blade 15 for driving a nail N as a fastener into a workpiece W. A magazine 16 for accommodating a large number of nails N is attached to a tip part of the main case 12, and a nose plate 17 for guiding the nail N struck by the driver blade 15 is provided at the tip part of the magazine 16.

Figure 3:
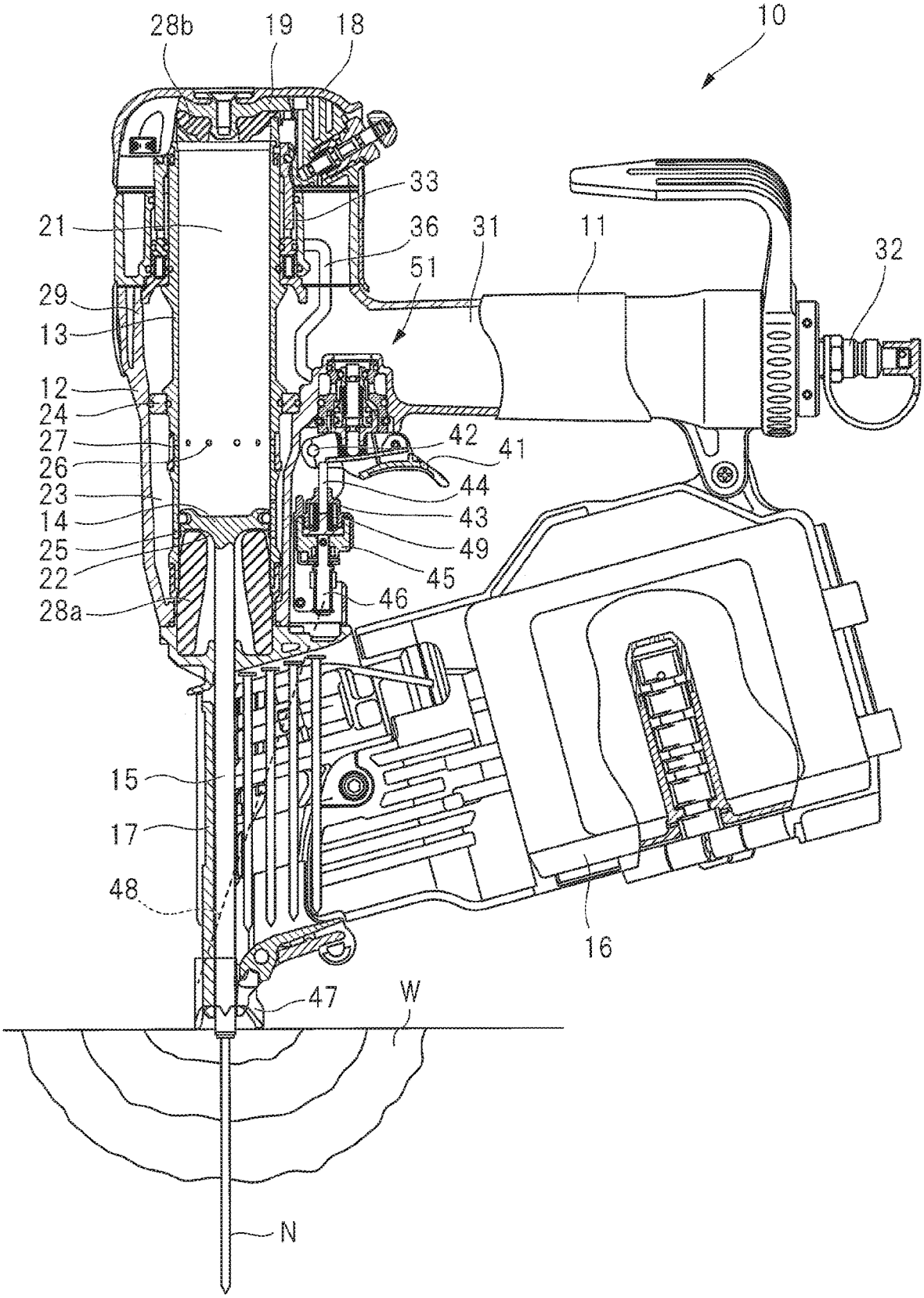
FIG. 3 is a partially cutaway side view of the fastener driving tool in a state in which the fastener is struck.

A head cover 19 is attached to the head case 18 provided at a base end part of the main case 12. The inside of the cylinder 13 is partitioned by the main piston 14 into a pressure chamber 21 for driving provided on the base end part side of the cylinder 13 and a pressure chamber 22 for return provided on the tip part side of the cylinder 13. When compressed air is supplied to the pressure chamber 21, the main piston 14 is driven forward to the tip part side of the cylinder 13 as illustrated in FIG. 3. Thus, a tip part of the driver blade 15 is driven to a tip part of the nose plate 17, and the nail N is struck. The movement of the main piston 14 in the direction of striking the driver blade 15 is referred to as forward movement, and the movement of the piston 14 in the opposite direction is referred to as backward movement.

Figure 1:
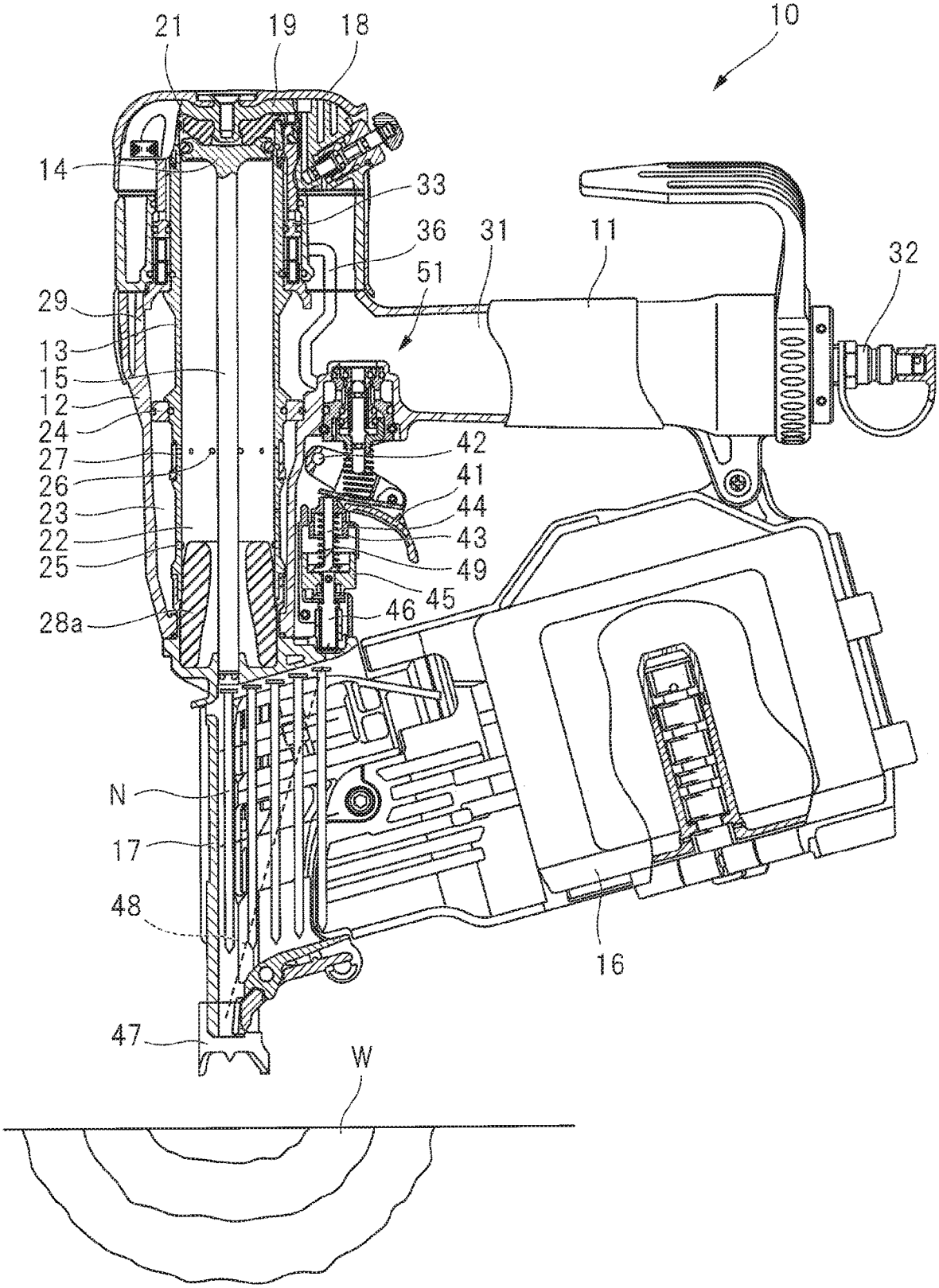
FIG. 1 is a partially cutaway side view of a fastener driving tool according to an embodiment in a state before a fastener is struck.

An air chamber 23 for recovery is partitioned by a ring-shaped partition member 24 between the tip part of the cylinder 13 and the main case 12, and when the main piston 14 moves forward from a backward limit position illustrated in FIG. 1 to a striking position illustrated in FIG. 3, air in the pressure chamber 22 is supplied to the air chamber 23 through an air hole 25 provided at the tip part of the cylinder 13 and an air hole 26 provided on a side closer to the base end part side of the cylinder 13 than the air hole 25. A check valve 27 is provided outside of the cylinder 13, and the check valve 27 allows air to flow from the pressure chamber 22 to the air chamber 23, and prevents air from flowing in the opposite direction. A damper 28*a* made of rubber is provided in the tip part of the cylinder 13 in order to buffer impact of the main piston 14 when the main piston 14 is in a forward limit position as illustrated in FIG. 3.

The main piston 14 in the forward limit position is driven to the backward limit position by compressed air flowed into the air chamber 23. At this time, the compressed air injected into the air chamber 23 flows through the air hole 25 into the pressure chamber 22 for return. When the main piston 14 moves backward, the compressed air in the pressure chamber 21 is exhausted outside while the sound is muffled by a muffler, not illustrated, provided in a muffler case part 29. A stopper 28*b* made of rubber is attached to the head cover 19 in order to buffer impact of the main piston 14 when the main piston 14 is driven from the forward limit position illustrated in FIG. 3 to the backward limit position illustrated in FIG. 1, and a rear end part of the cylinder 13 abuts on the stopper 28*b*.

Figure 2:
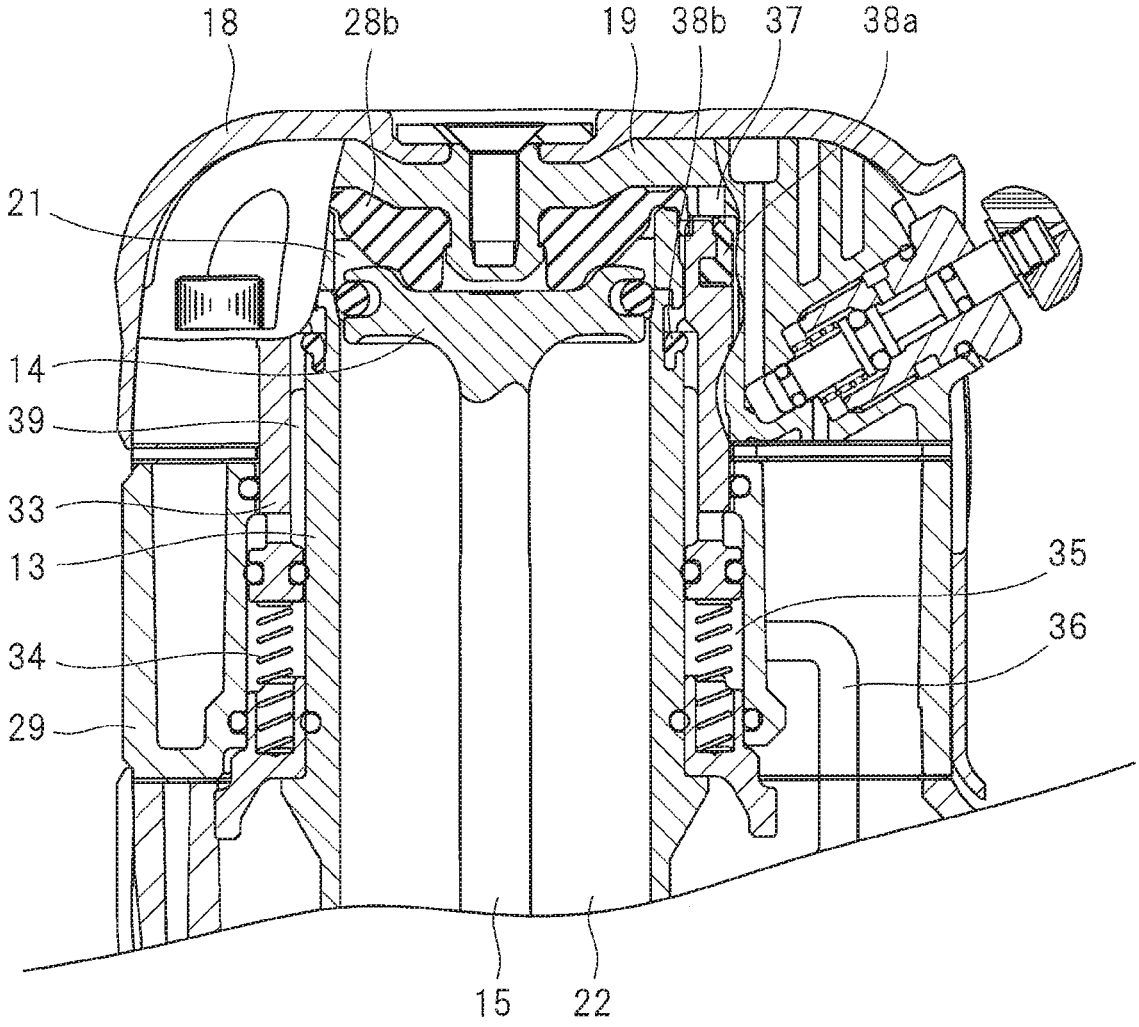
FIG. 2 is an enlarged cross-sectional view illustrating part of FIG. 1.
Figure 4:
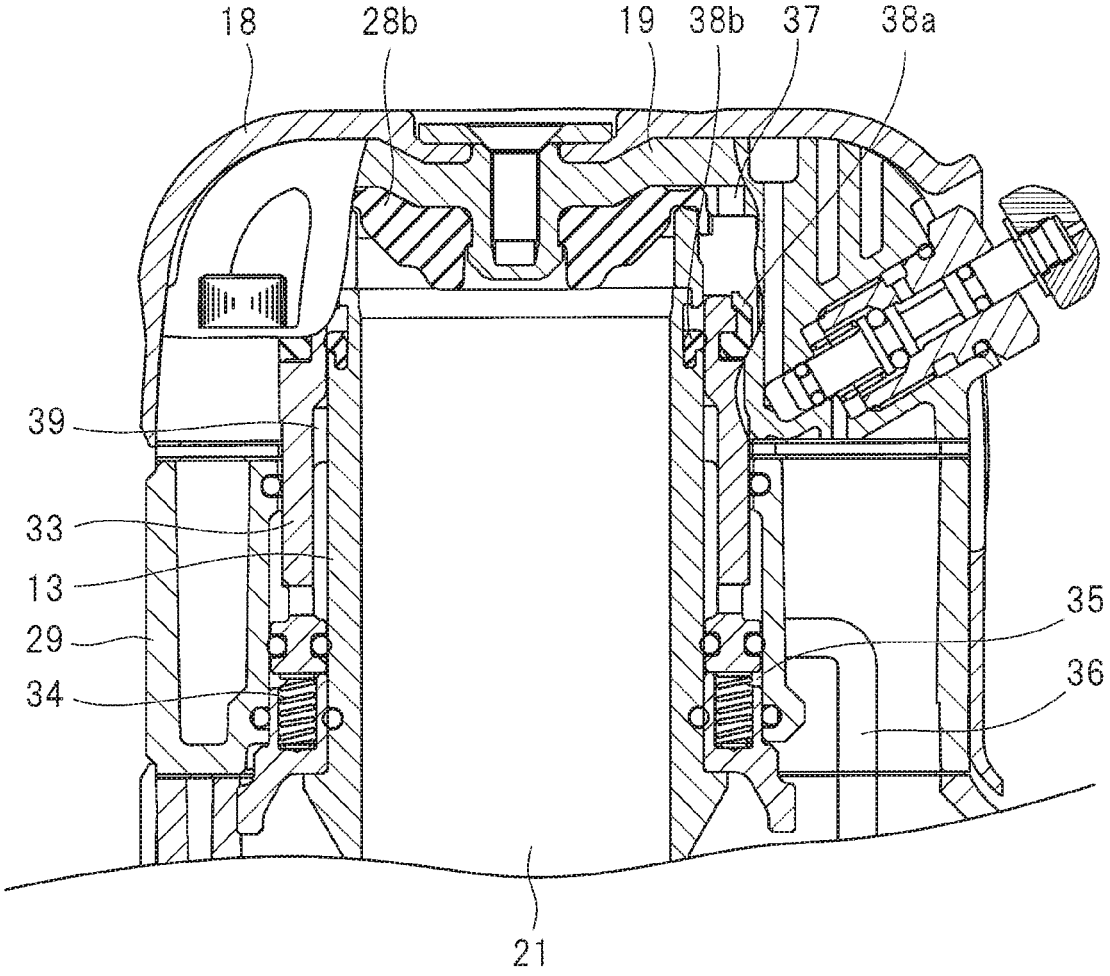
FIG. 4 is an enlarged cross-sectional view illustrating part of FIG. 3.

As illustrated in FIG. 1, a pressure accumulation chamber 31 is provided inside the handle 11. A plug 32 for air supply is provided at a base end part of the handle 11 in order to supply compressed air to the pressure accumulation chamber 31 from outside, and an air-pressure supply hose, not illustrated, is detachably mounted to the plug 32. As illustrated in FIGS. 2 and 4, a cylindrical sleeve valve 33 is axially movably mounted on the outside of the cylinder 13. The sleeve valve 33 is actuated between a driving position where the sleeve valve 33 causes compressed air filled in the pressure accumulation chamber 31 to be supplied to the pressure chamber 21 for driving as illustrated in FIG. 4, and a return position where the sleeve valve 33 stops supply of the compressed air to the pressure chamber 21 and causes the compressed air in the pressure chamber 21 to be exhausted outside via the muffler as illustrated in FIG. 2.

As illustrated in FIGS. 2 and 4, a spring force in a direction toward the return position is applied to the sleeve valve 33 by a compression coil spring 34. A valve drive chamber 35 is provided on the lower end surface side of the sleeve valve 33 in order to apply a thrust force in the direction toward the return position to the sleeve valve 33 in addition to the spring force, and an air supply and exhaust flow passage 36 for supplying compressed air in the pressure accumulation chamber 31 into the valve drive chamber 35 communicates with the valve drive chamber 35. An air-supply port 37 supplying compressed air in the pressure accumulation chamber 31 to the pressure chamber 21 is provided on the head cover 19.

When compressed air is supplied to the valve drive chamber 35 and the sleeve valve 33 is in the return position illustrated in FIG. 2, communication between the air-supply port 37 and the pressure chamber 21 is shut off by a seal member 38*a* provided at the sleeve valve 33. Furthermore, a seal member 38*b* provided at the cylinder 13 separates from the sleeve valve 33, and an exhaust flow passage 39 communicates with the pressure chamber 21. Thus, supply of compressed air to the pressure chamber 21 is stopped, and compressed air in the pressure chamber 21 is exhausted to the outside via the exhaust flow passage 39 and the muffler. Therefore, the main piston 14 is driven to the backward limit position by compressed air in the air chamber 23, and the driver blade 15 is driven to a backward limit position illustrated in FIG. 1. At this time, compressed air flowed in through the air-supply port 37 is supplied to the outer peripheral surface of the seal member 38*a*.

When compressed air in the valve drive chamber 35 is exhausted, as illustrated in FIG. 4, the sleeve valve 33 is driven from the return position to the driving position due to pressure of compressed air applied from the air-supply port 37 to an upper end part of the sleeve valve 33. Thus, compressed air is supplied from the air-supply port 37 to the pressure chamber 21, the main piston 14 is driven forward, the driver blade 15 is struck, and the nail N is driven into the workpiece W. At this time, the seal member 38*b* comes in contact with the inner peripheral surface of the sleeve valve 33, and the exhaust flow passage 39 is shut off.

A trigger 41 is mounted to the main case 12 swingably around a support shaft 42. The trigger 41 is operated between a striking stop position, that is, an OFF position, illustrated in FIG. 1, and a striking enabling position, that is, an ON position, illustrated in FIG. 3 by a worker.

A push lever 44 is mounted to a holder 43 provided at the main case 12 such that the push lever 44 can axially reciprocate. A spring receiving member 45 is mounted to the holder 43 so as to be capable of axially reciprocating, and a push rod 46 attached to a spring receiving member 45 is connected to a push member 47 movably mounted to the nose plate 17 via a connecting member 48 illustrated by a broken line. A compression coil spring 49 is mounted to the push lever 44, one end of the compression coil spring 49 is brought into contact with a flange part 44*a* of the push lever 44, and the other end of the compression coil spring 49 is brought into contact with the holder 43. A spring force in a direction toward a position where a tip part of the push lever 44 enters the holder 43, that is, a striking stop position, is applied to the push lever 44 by the compression coil spring 49.

When the push member 47 is disposed at the tip part of the fastener driving tool 10 and a worker drives the nail N into the workpiece W, the nose plate 17 is pressed against the workpiece W, and then, the push member 47 abuts on the workpiece W. Thus, the push member 47 is driven backward along the nose plate 17, and the push lever 44 is driven to a striking enabling position projected from the holder 43 as illustrated in FIG. 3 via the connecting member 48 and the push rod 46. Meanwhile, when the push member 47 separates from the workpiece W, the push member 47 is driven to a forward limit position. Thus, the push lever 44 is driven to the striking stop position as illustrated in FIG. 1.

A trigger valve 51 is provided at the main case 12 in order to drive the driver blade 15 when the push lever 44 is driven to the striking enabling position and then the trigger 41 is operated to the striking enabling position under a state in which the main piston 14 is in the backward limit position, that is, the driver blade 15 is returned to the backward limit position, as illustrated in FIG. 1. As described, the trigger valve 51 is exclusively used for single driving.

As illustrated in FIGS. 5 to 17, the trigger valve 51 includes a piston case 53 mounted in an accommodation chamber 52 provided in the main case 12. The piston case 53 has a stepped cylindrical shape. An opening part 54 communicating with the pressure accumulation chamber 31 is provided at one end part of the piston case 53, and an exhaust port 55 communicating with the outside is provided at the other end part of the piston case 53. Furthermore, a communication port 56 is provided radially penetrating the piston case 53. The communication port 56 communicates with a communication chamber 57 provided outside the piston case 53, and the communication chamber 57 communicates with the valve drive chamber 35 via the air supply and exhaust flow passage 36. Seal members 58*a* and 58*b* are mounted to the outer peripheral surface of the piston case 53 in order to seal both sides of the communication chamber 57.

Figure 5:
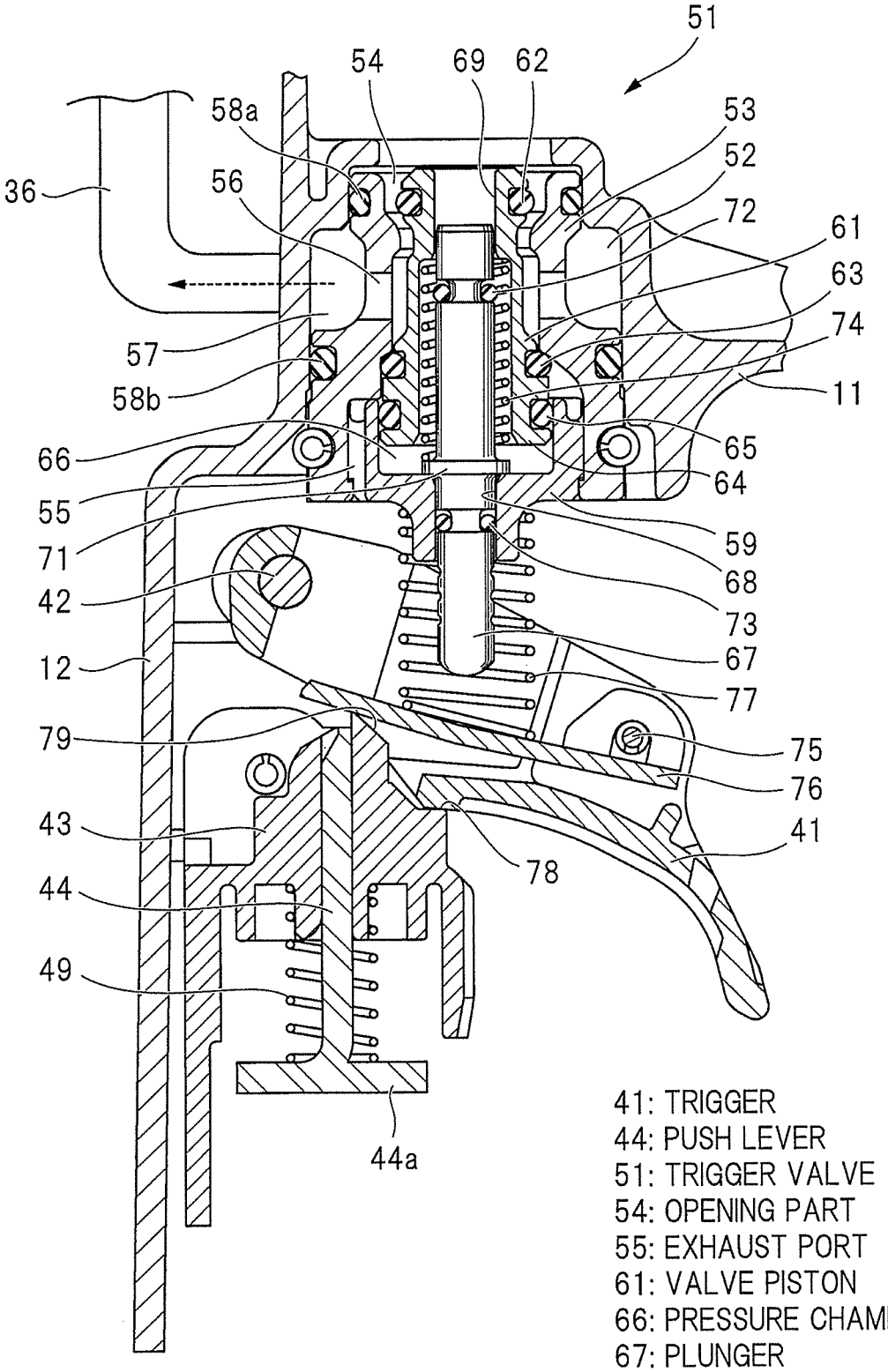
FIG. 5 is a cross-sectional view illustrating an actuation state of a trigger valve when a trigger and a push lever are in striking stop positions.
Figure 7:
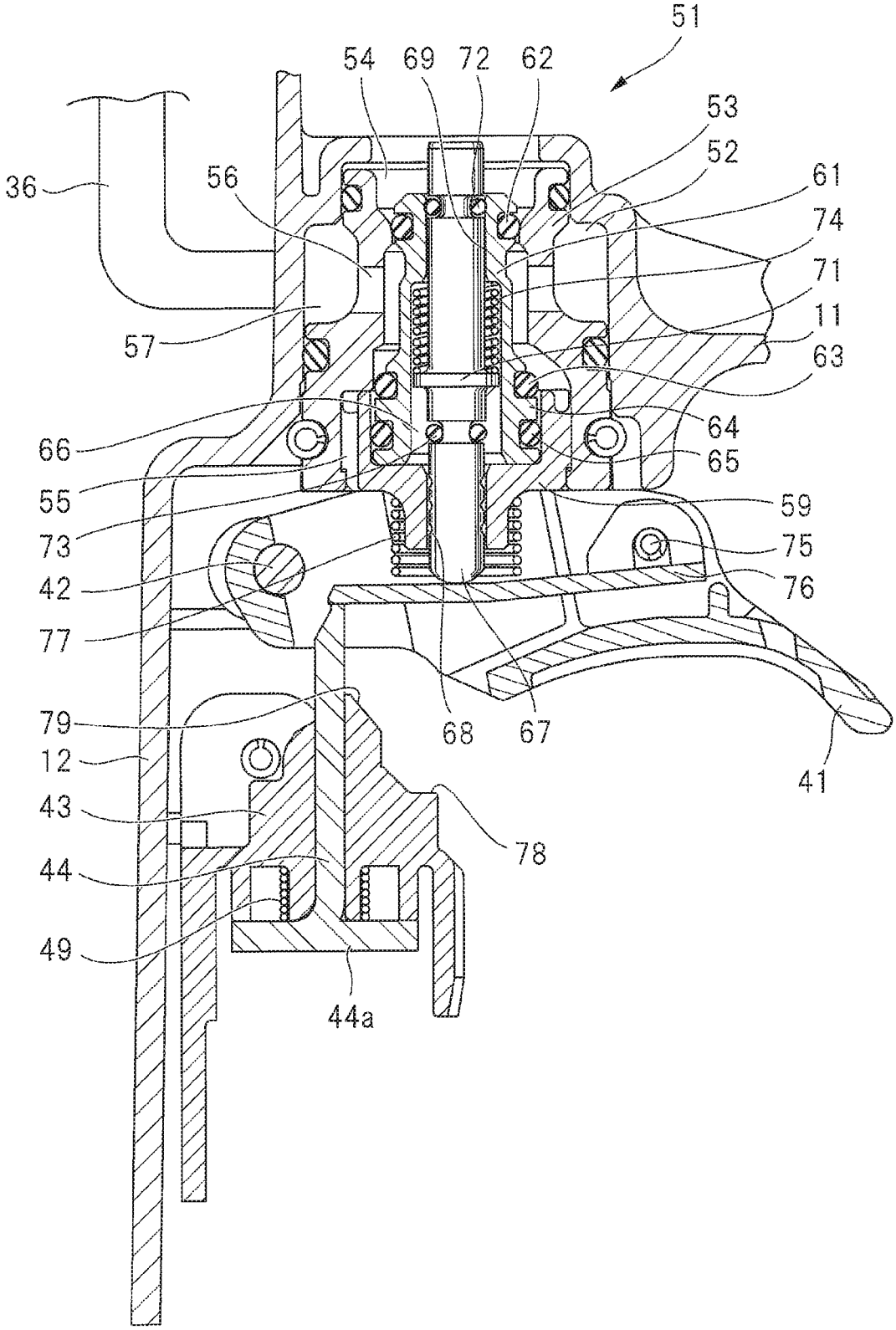
FIG. 7 is a cross-sectional view illustrating the actuation state of the trigger valve when the trigger is operated to the striking enabling position after the push lever is driven to the striking enabling position from the state in FIG. 5 and then a fastener is struck.

A rod cover 59 is mounted in the other end part of the piston case 53. The rod cover 59 constitutes part of the piston case 53, and an exhaust port 55 is formed between the rod cover 59 and the piston case 53. A hollow valve piston 61 is axially movably mounted in the piston case 53. The valve piston 61 moves between an air-supply position, that is, a striking preparation position, where the valve piston 61 causes the opening part 54 and the communication port 56 to communicate with each other and blocks the exhaust port 55 as illustrated in FIG. 5, and an exhaust position, that is, a striking position, where the valve piston 61 blocks the opening part 54 and causes the exhaust port 55 and the communication port 56 to communicate with each other as illustrated in FIG. 7. When the valve piston 61 is in the air-supply position, compressed air in the pressure accumulation chamber 31 is supplied to the valve drive chamber 35 of the sleeve valve 33 via the air supply and exhaust flow passage 36. Thus, the main piston 14 and the driver blade 15 are in the backward limit positions, that is, the position where the driver blade is returned as illustrated in FIG. 1. Meanwhile, when the valve piston 61 is in the exhaust position under a state in which compressed air is supplied to the valve drive chamber 35, compressed air in the valve drive chamber 35 is exhausted outside via the air supply and exhaust flow passage 36 and the exhaust port 55. Thus, compressed air is supplied to the pressure chamber 21 of the main piston 14, and the main piston 14 and the driver blade 15 are driven to the forward limit positions, that is, the driving positions as illustrated in FIG. 3.

A seal member 62 for air-supply shutoff configured to open and close the opening part 54 is provided at one end part of the valve piston 61. A seal member 63 for exhaust shutoff configured to open and close the exhaust port 55 is provided at the other end part of the valve piston 61. When the valve piston 61 is in the air-supply position, the seal member 62 separates from a valve seat surface of the inner peripheral surface of the piston case 53 and opens the opening part 54, and the seal member 63 is closely fitted to the valve seat surface of the inner peripheral surface of the piston case 53 and closes the exhaust port 55. Conversely, when the valve piston 61 is in the exhaust position, the seal member 62 is closely fitted to the valve seat surface of inner peripheral surface of the piston case 53 and closes the opening part 54, and the seal member 63 separates from the valve seat surface of the inner peripheral surface of the piston case 53 and opens the exhaust port 55.

A sliding piston part 64 is provided at the other end part of the valve piston 61. A seal member 65 slidably coming in contact with a cylindrical inner peripheral surface of the rod cover 59 is mounted to the sliding piston part 64. A pressure chamber 66 is partitioned in the piston case 53 by the sliding piston part 64 and the rod cover 59.

A plunger 67 is axially movably mounted in the valve piston 61. A tip part of the plunger 67 penetrates through a through hole 68 on the exhaust side provided in the rod cover 59 and projects from the rod cover 59 toward the trigger 41. A base end part of the plunger 67 is slidably in contact with a through hole 69 on the air supply side provided in the valve piston 61. A flange part 71 brought into contact with the rod cover 59 is provided at the plunger 67. When the flange part 71 is brought into contact with the rod cover 59, the plunger 67 is in a projection limit position as illustrated in FIG. 5. The projection limit position of the plunger 67 is a communication position where the plunger 67 causes the pressure accumulation chamber 31 and the pressure chamber 66 to communicate with each other via the through hole 69. When the plunger 67 is in the communication position, compressed air in the pressure accumulation chamber 31 is supplied to the pressure chamber 66, and the valve piston 61 is driven to the air-supply position as illustrated in FIG. 5. When the valve piston 61 is in the air-supply position, compressed air is supplied to the valve drive chamber 35 of the sleeve valve 33, and the driver blade 15 is in the backward limit position as illustrated in FIG. 1.

A seal member 72 for communication shutoff configured to come in contact with the through hole 69 is provided at the base end part of the plunger 67. When the plunger 67 moves backward in a direction in which a projection end part of the plunger 67 enters the rod cover 59, the seal member 72 comes in contact with the through hole 69, and communication between the pressure accumulation chamber 31 and the pressure chamber 66 is shut off. Even when the axial position of the plunger 67 with respect to the valve piston 61 changes, since communication between the pressure accumulation chamber 31 and the pressure chamber 66 is shut off in a state in which the seal member 72 is in contact with the through hole 69, the plunger 67 is in a shutoff position.

A seal member 73 for exhaust switching configured to come in contact with the through hole 68 is provided at the tip part of the plunger 67. When the plunger 67 moves backward under a state in which the seal member 72 comes in contact with the through hole 69 and the plunger 67 is in the shutoff position, the seal member 73 separates from the through hole 68, and the pressure chamber 66 communicates with outside. Thus, compressed air in the pressure chamber 66 is exhausted, and the valve piston 61 is in the exhaust position. When the valve piston 61 is in the exhaust position, compressed air in the valve drive chamber 35 of the sleeve valve 33 is exhausted, and the driver blade 15 is in the driving position illustrated in FIG. 3.

A compression coil spring 74 is mounted to the outside of the plunger 67. One end of the compression coil spring 74 is brought into contact with a step part formed inside the valve piston 61, and the other end of the compression coil spring 74 is brought into contact with the flange part 71. The compression coil spring 74 applies a spring force in a projecting direction to the plunger 67 and applies a spring force in a direction toward the air-supply position to the valve piston 61.

A trigger arm 76 is swingably attached to a swinging end of the trigger 41 by a support pin 75. A tip part of the trigger arm 76 extends to a position facing the holder 43. A compression coil spring 77 is mounted as a spring member between the trigger arm 76 and the rod cover 59. The compression coil spring 77 applies to the trigger arm 76 a spring force in a direction in which the tip part of the trigger arm 76 is pressed against the holder 43, and applies to the trigger 41 a spring force in a direction toward the striking stop position. The striking stop position of the trigger 41 is restricted by a stopper 78 of the holder 43.

Figure 6:
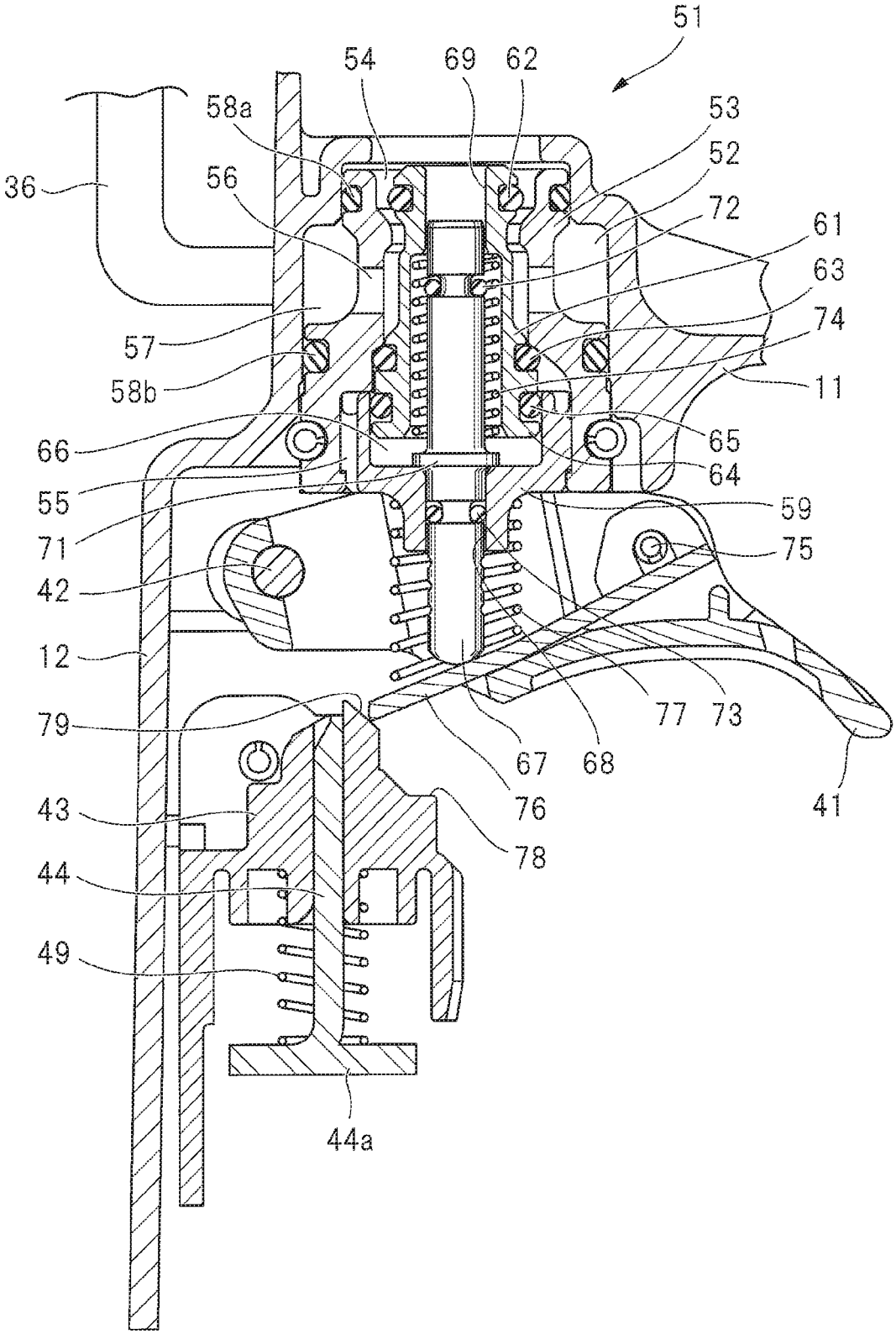
FIG. 6 is a cross-sectional view illustrating an actuation state of the trigger valve when the trigger is pulled to a striking enabling position from the state in FIG. 5.

When the trigger 41 is also in the striking stop position as illustrated in FIG. 5 under a state in which the push lever 44 is in the striking stop position, the trigger arm 76 protrudes in front of the push lever 44. When the trigger 41 is operated to the striking enabling position as illustrated in FIG. 6 under this state, the trigger arm 76 separates from the front of the push lever 44. At this time, the tip of the trigger 41 comes in contact with an inclined arm guide surface 79 formed on the end surface of the holder 43, and the trigger arm 76 does not drive the plunger 67. As described, the trigger arm 76 is set to have a length such that the trigger arm 76 is actuated in the position where the trigger arm 76 protrudes in front of the push lever 44 and in a position where the trigger arm 76 separates from the front of the push lever 44 and comes in contact with the arm guide surface 79 when the trigger 41 is operated under a state in which the push lever 44 is in the striking stop position.

Next, a driving operation of single driving of the nail N using the above-described fastener driving tool 10 will be described with reference to FIGS. 5 to 17.

As illustrated in FIG. 5, when both the trigger 41 and the push lever 44 are in the striking stop positions, that is, the OFF positions, the tip part of the trigger arm 76 protrudes in front of the tip part of the push lever 44. Under this state, the plunger 67 is in the communication position, and compressed air in the pressure accumulation chamber 31 is supplied to the pressure chamber 66 via the through hole 69 and a gap between the plunger 67 and the valve piston 61. Thus, the valve piston 61 is in the air-supply position, that is, the striking preparation position. When the valve piston 61 is in the air-supply position, compressed air in the pressure accumulation chamber 31 is supplied to the valve drive chamber 35 via the air supply and exhaust flow passage 36, and the main piston 14 and the driver blade 15 are driven to the backward limit positions illustrated in FIGS. 1 and 2.

Under this state, when the trigger 41 is operated to the striking enabling position by a worker, the tip part of the trigger arm 76 separates from the front of the push lever 44 and is in a position where the tip part does not interfere with the push lever 44 as illustrated in FIG. 6. Therefore, even when the worker operates the fastener driving tool 10 to press the push member 47 against the workpiece W and to drive the push lever 44 to the driving enabling position under this state, the plunger 67 will not be driven. The valve piston 61 keeps the air-supply position. Under the state illustrated in FIG. 6, the tip of the trigger arm 76 comes in contact with the arm guide surface 79. Since the arm guide surface 79 inclines upward toward the push lever 44 side, when the trigger 41 is returned from the striking enabling position illustrated in FIG. 6 to the striking stop position, the tip of the trigger arm 76 slides on the arm guide surface 79 and is in the position illustrated in FIG. 5.

In order to drive the nail N into the workpiece W, the push member 47 is pressed against the workpiece W, the push lever 44 is driven to the striking enabling position, and the trigger 41 is operated to the striking enabling position as illustrated in FIG. 7. Then, the seal member 72 for communication shutoff comes in contact with the through hole 69, and the plunger 67 is in the shutoff position. At this time, the seal member 73 for exhaust switching separates from the through hole 68. Thus, since compressed air in the pressure chamber 66 is exhausted outside via a gap between the plunger 67 and the through hole 68, the valve piston 61 is driven to the exhaust position. When the valve piston 61 is in the exhaust position, the seal member 62 blocks the opening part 54, and the communication port 56 and the exhaust port 55 communicate with each other. Therefore, compressed air in the valve drive chamber 35 is exhausted outside via the air supply and exhaust flow passage 36, the communication port 56, and the exhaust port 55. When the compressed air in the valve drive chamber 35 is exhausted, compressed air is supplied to the pressure chamber 21, and the main piston 14 and the driver blade 15 are driven forward to the driving positions as illustrated in FIGS. 3 and 4. Thus, the nail N is driven.

Figure 8:
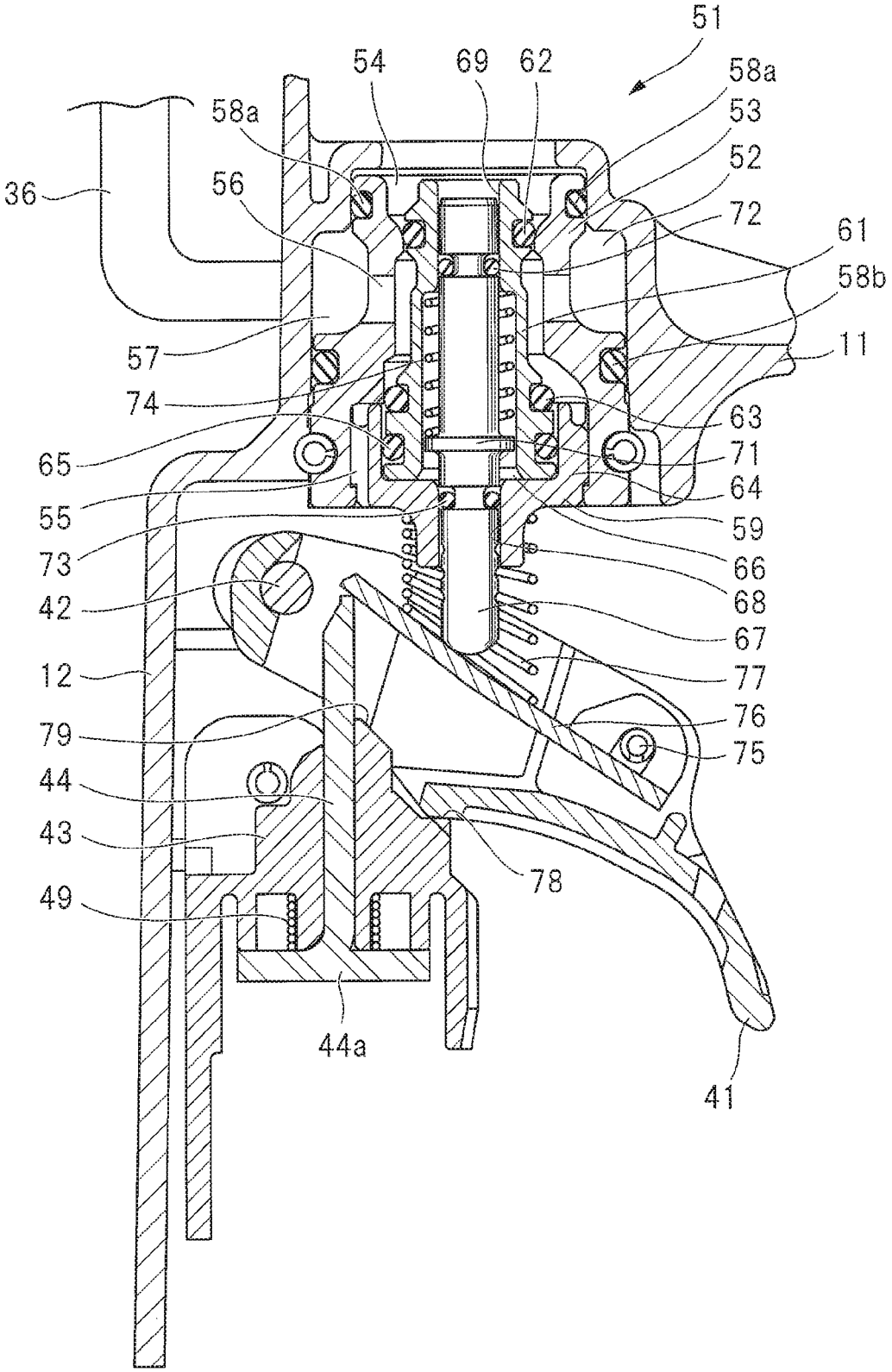
FIG. 8 is a cross-sectional view illustrating the actuation state of the trigger valve when only the trigger is operated to the striking stop position after the fastener is struck.

Under the state in which a driving operation is performed and the valve piston 61 is in the exhaust position, even when the trigger 41 is returned to the striking stop position as illustrated in FIG. 8, the valve piston 61 keeps the exhaust position, and the driver blade 15 is in the driving position. Even when the trigger 41 is returned from the striking enabling position illustrated in FIG. 7 to the striking stop position illustrated in FIG. 8, since the trigger arm 76 is brought into contact with the push lever 44, the valve piston 61 still keeps the shutoff position where the seal member 72 for communication shutoff closes the through hole 69. Therefore, compressed air is not supplied to the pressure chamber 66, the valve piston 61 is in the exhaust position, the opening part 54 is closed by the seal member 62 for air-supply shutoff, and compressed air will not be supplied to the valve drive chamber 35.

Figure 9:
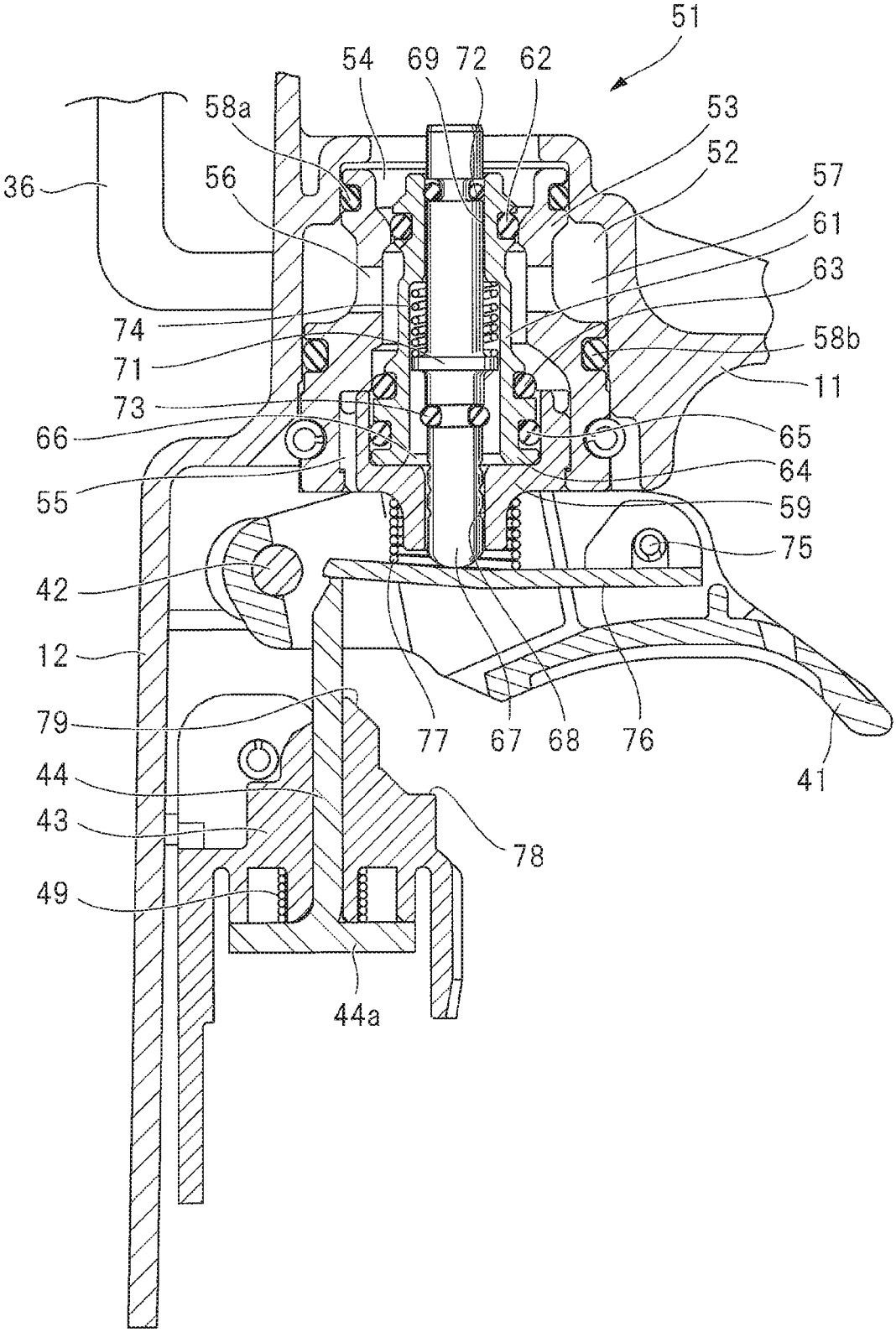
FIG. 9 is a cross-sectional view illustrating the actuation state of the trigger valve when the trigger is operated again to the striking enabling position under the state in FIG. 8.

As described, under the state in which the valve piston 61 is driven to the exhaust position and the push lever 44 is driven to the striking enabling position, even when the trigger 41 is operated, the plunger 67 has a stroke which keeps the shutoff position, and the valve piston 61 keeps the exhaust position. Therefore, under the state in FIG. 8, even when the trigger 41 is operated again to the striking enabling position as illustrated in FIG. 9, since the driver blade 15 is still in the striking position, a driving operation cannot be performed. That is, a conventional mode of continuous driving is prevented.

Figure 10:
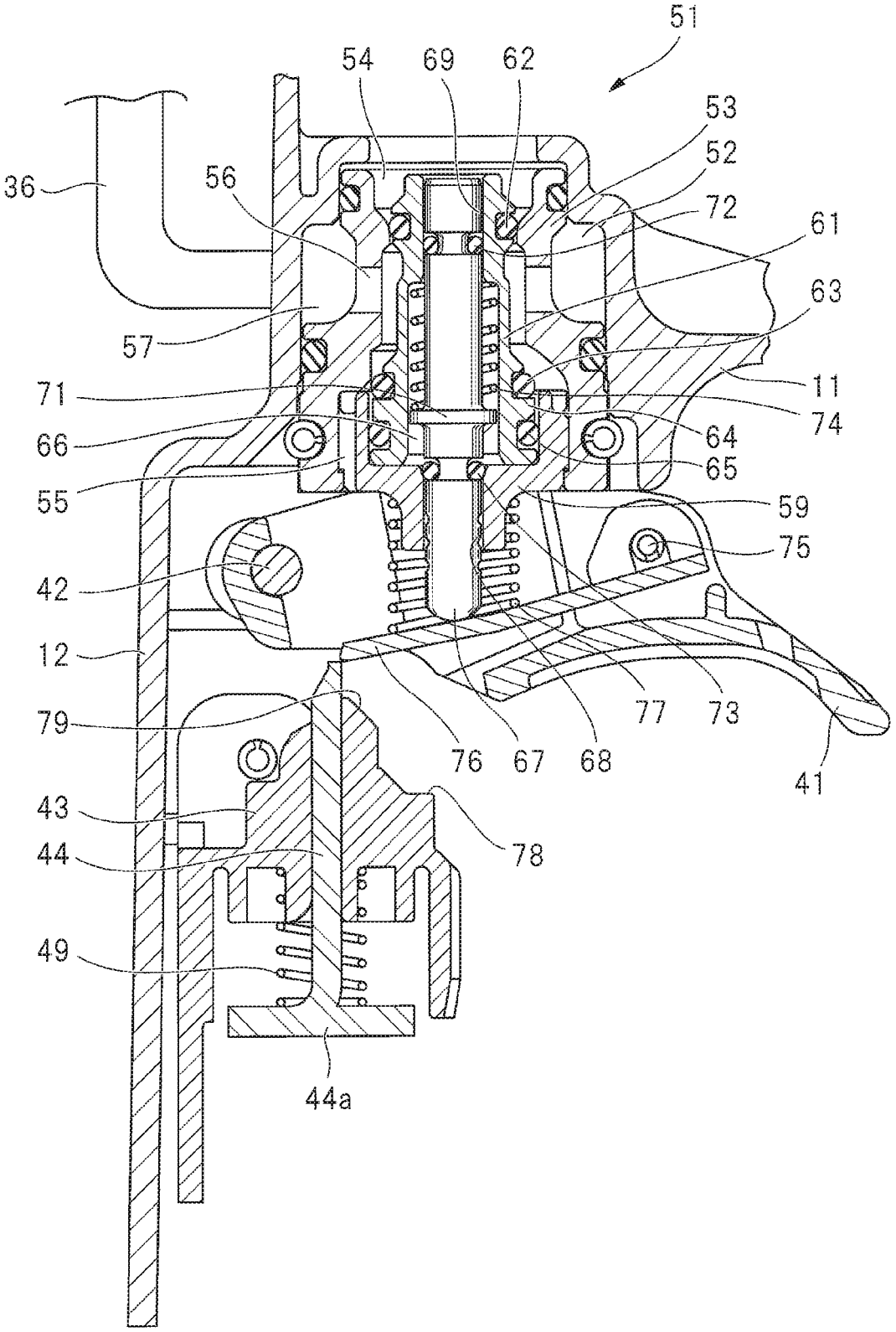
FIG. 10 is a cross-sectional view illustrating the working state of the trigger valve when the push lever is being driven toward the striking stop position under the state in FIG. 9.

FIG. 10 illustrates a state in which the fastener driving tool 10 is operated in a direction separating from the workpiece W and the push lever 44 is being driven toward the striking stop position when the state in which the valve piston 61 is in the exhaust position and the trigger 41 is operated to the striking enabling position is kept. When the push lever 44 is driven toward the striking stop position, the plunger 67 moves and projects correspondingly to the movement of the push lever 44 while still being in the shutoff position where the seal member 72 comes in contact with the through hole 69, and the valve piston 61 is still in the exhaust position.

Figure 11:
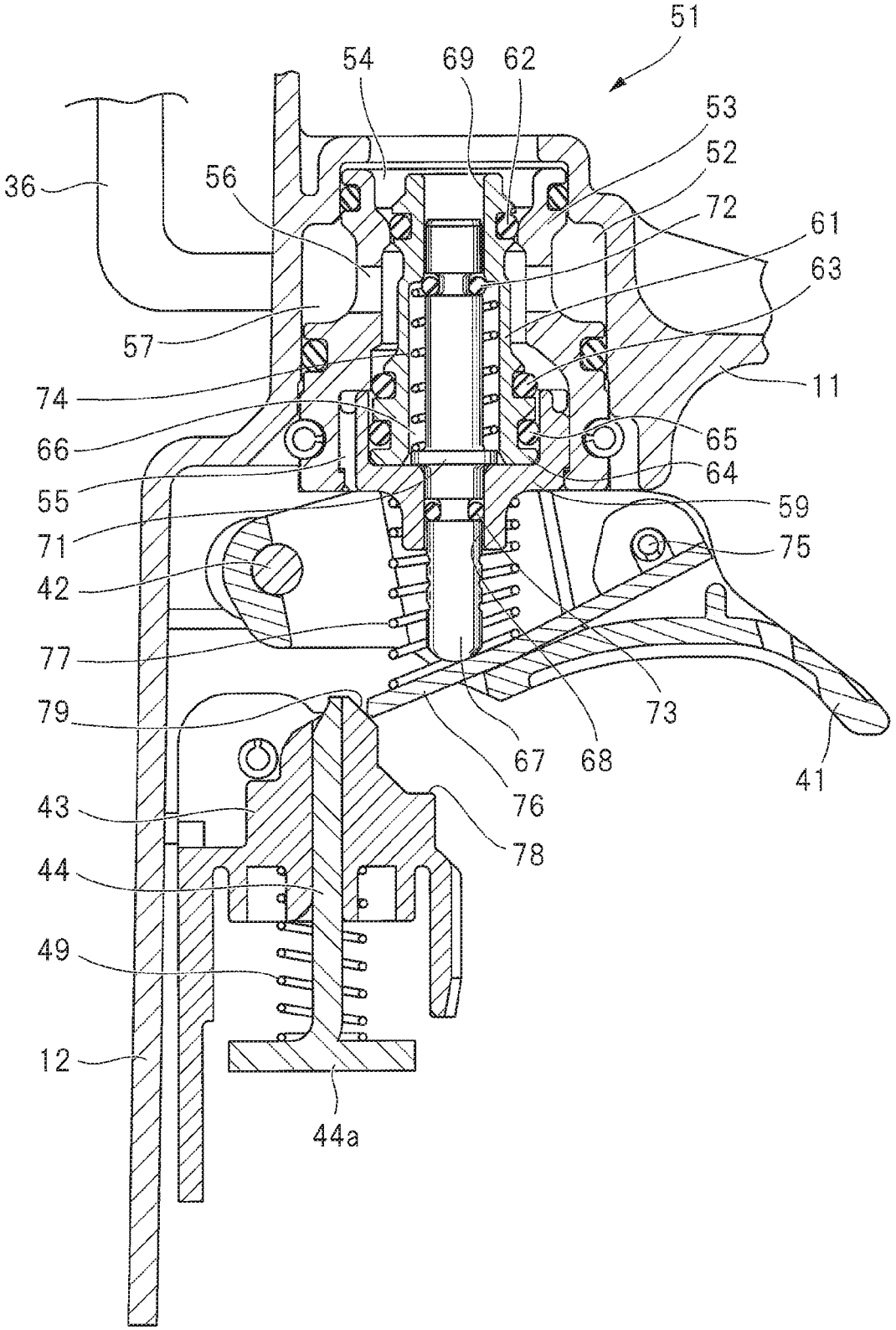
FIG. 11 is a cross-sectional view illustrating the actuation state of the trigger valve at the moment when the push lever is driven to the striking stop position from the state in FIG. 10.

FIG. 11 illustrates a moment when the push lever 44 is returned to the striking stop position from the state in FIG. 10. When the push lever 44 is returned to the striking stop position under the state in which the trigger 41 is operated to the striking enabling position, the flange part 71 is brought into contact with the rod cover 59, and the plunger 67 is in the projection limit position. When the plunger 67 is in the projection limit position, the seal member 73 blocks the through hole 68, the seal member 72 separates from the through hole 69, and compressed air in the pressure accumulation chamber 31 is supplied to the pressure chamber 66. At this time, the tip of the trigger arm 76 is in contact with the arm guide surface 79.

Figure 12:
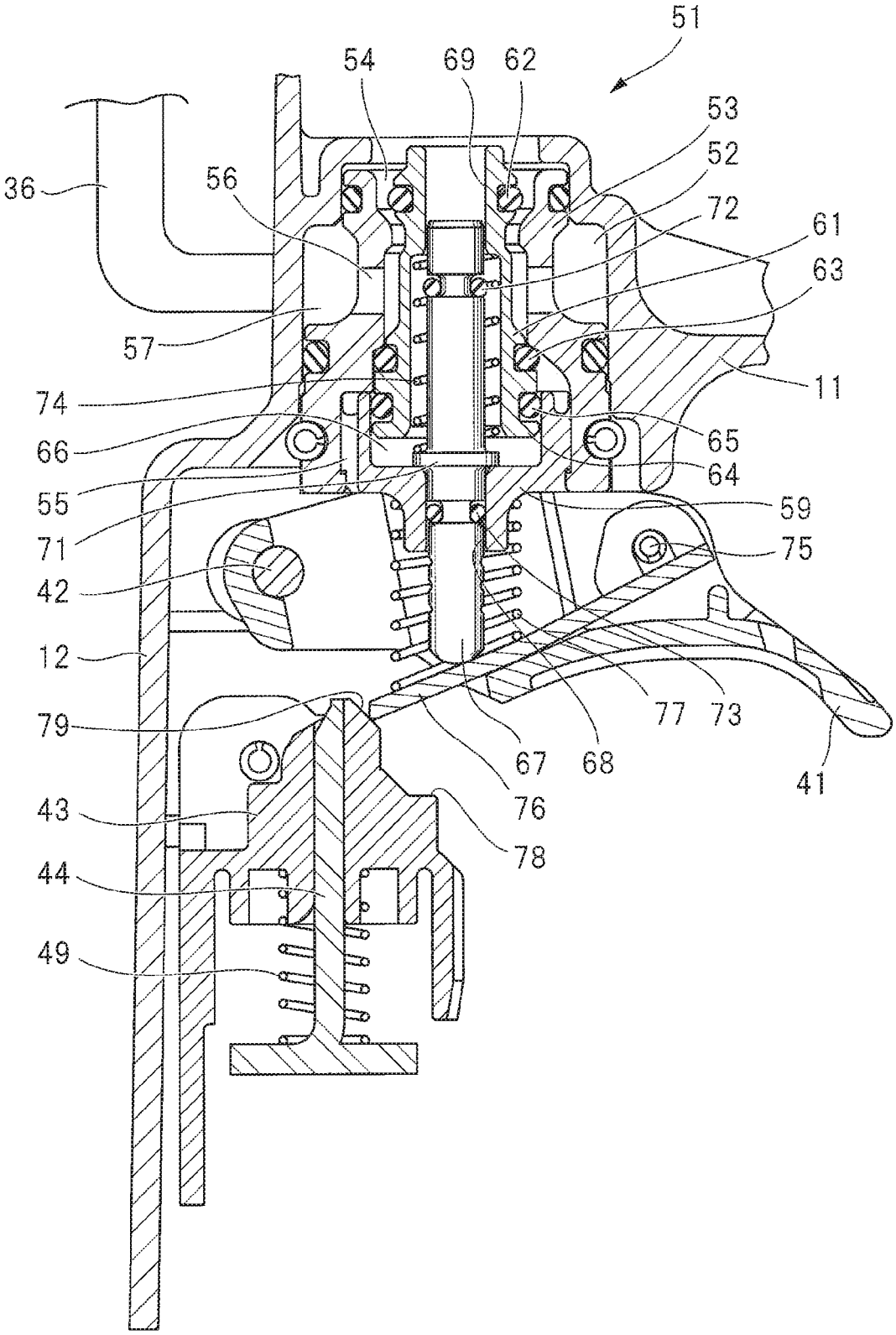
FIG. 12 is a cross-sectional view illustrating the actuation state of the trigger valve when the push lever is driven to the striking stop position as illustrated in FIG. 11 and switching to an air-supply position is performed.

When compressed air is supplied to the pressure chamber 66, the valve piston 61 is driven to the air-supply position by compressed air in the pressure chamber 66 as illustrated in FIG. 12. When the valve piston 61 is driven to the air-supply position, the opening part 54 is opened, and compressed air in the pressure accumulation chamber 31 is supplied to the valve drive chamber 35 via the communication port 56 and the air supply and exhaust flow passage 36. Thus, the driver blade 15 is returned to the backward limit position illustrated in FIGS. 1 and 2.

As described, when the push lever 44 is returned to the striking stop position under the state in which the valve piston 61 is driven to the exhaust position and the trigger 41 is held in the striking enabling position, the plunger 67 is driven to the communication position, and the valve piston 61 is driven to the air-supply position.

Figure 13:
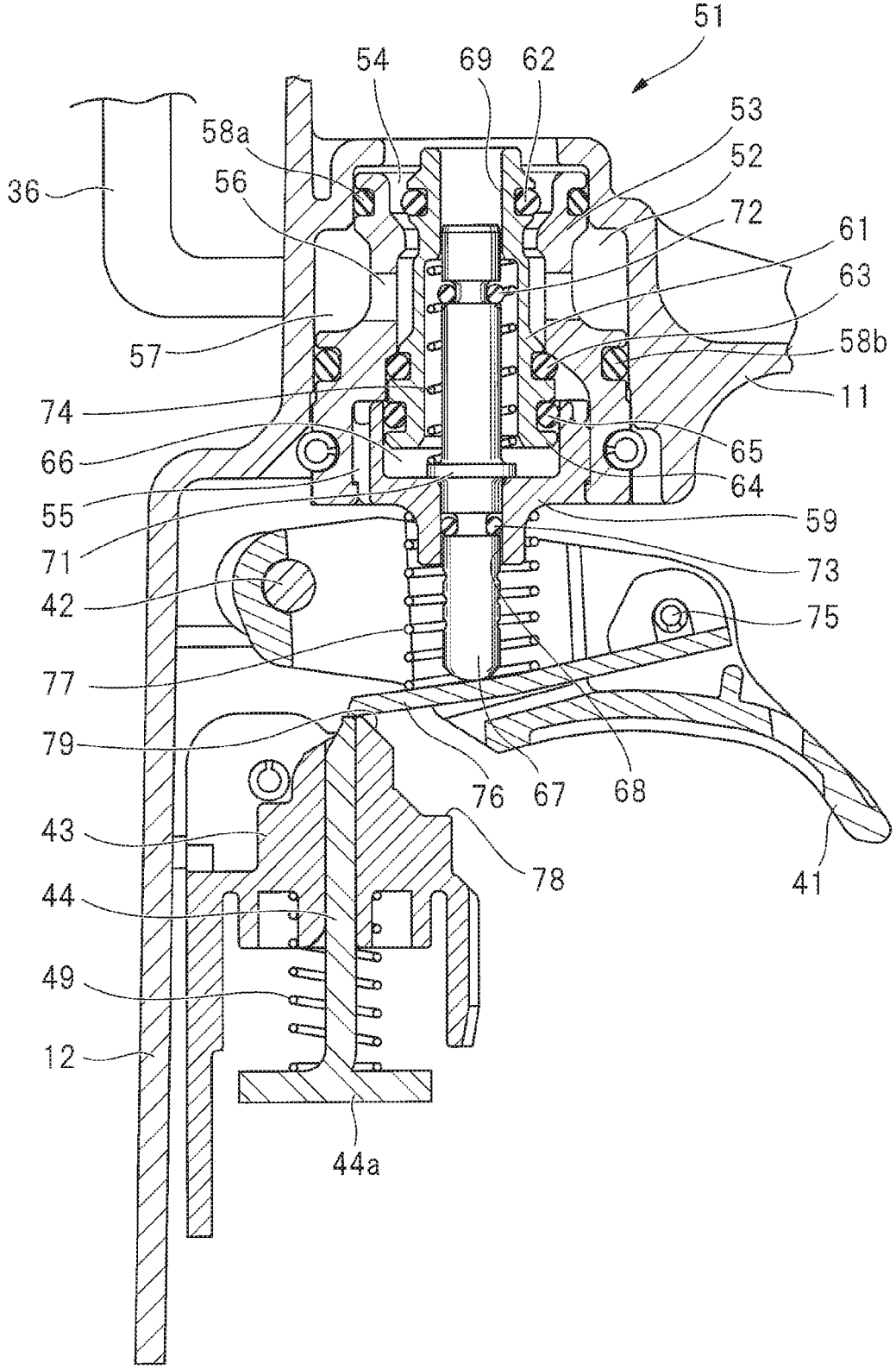
FIG. 13 is a cross-sectional view illustrating the actuation state of the trigger valve when the trigger is being operated toward the striking stop position under the state in FIG. 12.

FIG. 13 illustrates a state in which the trigger 41 is being operated to be returned from the striking enabling position toward the striking stop position under the state in FIG. 12. When the trigger 41 is returned toward the striking stop position, the tip part of the trigger arm 76 is guided by the arm guide surface 79 and moves so as to protrude in front of the push lever 44 under a state in which the push lever 44 is returned.

Figure 14:
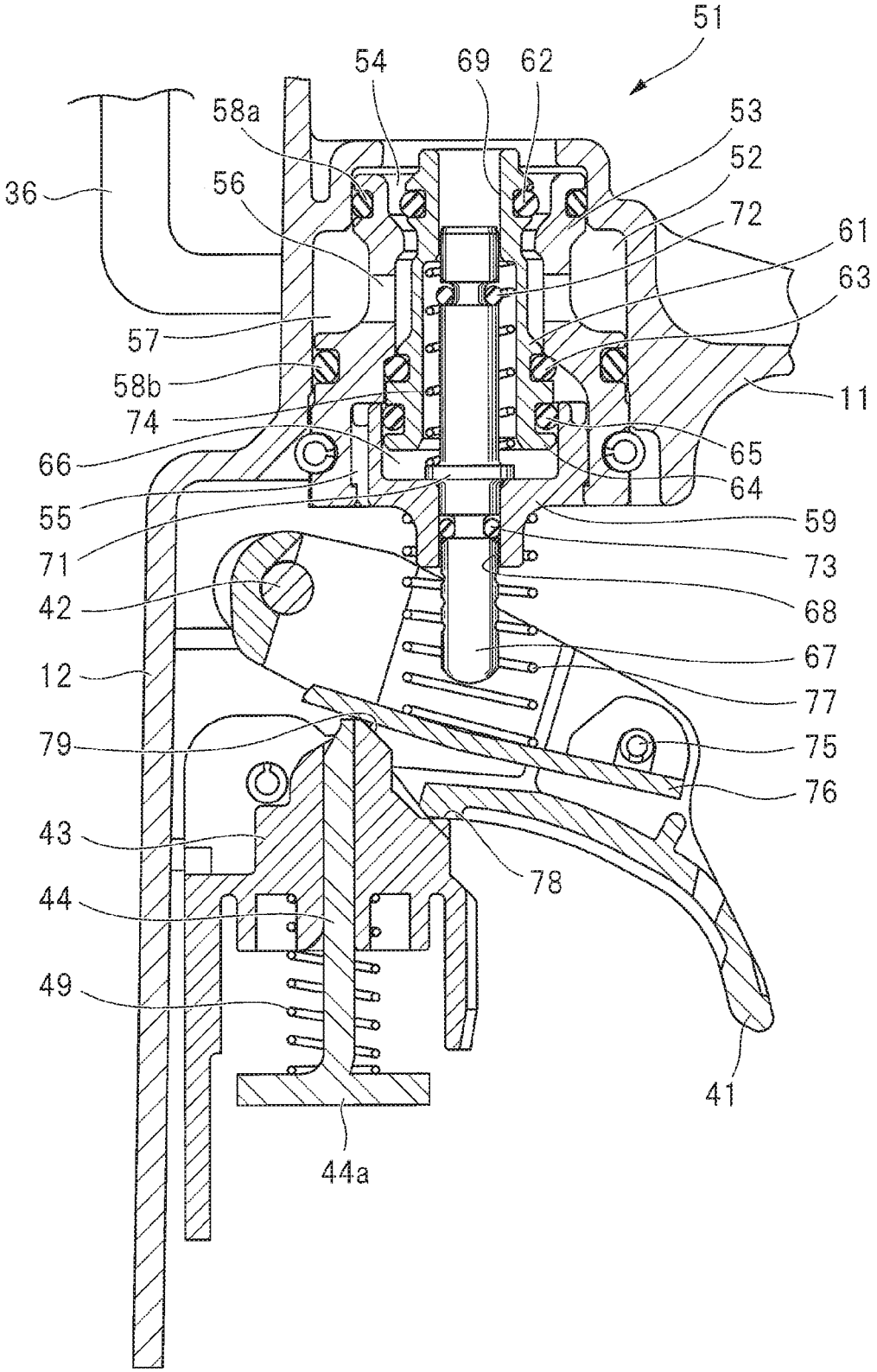
FIG. 14 is a cross-sectional view illustrating the actuation state of the trigger valve when the trigger is returned to the striking stop position from the state in FIG. 13.

FIG. 14 illustrates a state in which the trigger 41 is further returned from the state illustrated in FIG. 13 to the striking stop position. This state is similar to the state in FIG. 5, and under this state, even when a worker operates the fastener driving tool 10 to press the push member 47 against the workpiece Wand to drive the push lever 44 to the striking enabling position, the plunger 67 will not be driven, and the valve piston 61 is in the air-supply position, that is, the preparation position. As described, even when the trigger 41 is operated under a state in which the valve piston 61 is in the air-supply position, the plunger 67 is held in the communication position, and the valve piston 61 is held in the air-supply position.

In contrast, as illustrated in FIG. 7, when the push lever 44 is returned to the striking stop position in a state in which the trigger 41 is being operated to the striking enabling position after the nail N is driven, the valve piston 61 is driven to the air-supply position as illustrated in FIGS. 15 and 16. As described, when the push lever 44 is returned to the striking stop position under a state in which the valve piston 61 is driven to the exhaust position and the trigger 41 is driven to the striking enabling position, the plunger 67 is switched to the communication position, and the valve piston 61 is switched to the air-supply position.

FIG. 15 illustrates a state in which the push lever 44 is being returned from the striking enabling position toward the striking stop position. When the push lever 44 is returned while the trigger 41 is being operated to the striking enabling position, the plunger 67 moves and projects, the seal member 73 closes the through hole 68, and the seal member 72 opens the through hole 69 as illustrated in FIG. 15. Thus, compressed air in the pressure accumulation chamber 31 is supplied to the pressure chamber 66, and the valve piston 61 is switched to the air-supply position. Therefore, compressed air in the pressure accumulation chamber 31 is supplied to the valve drive chamber 35 via the communication port 56 and the air supply and exhaust flow passage 36, and the driver blade 15 is returned to the backward limit position.

As illustrated in FIG. 16, when the push lever 44 is returned to the striking stop position, the tip part of the trigger arm 76 moves back from the front of the push lever 44 and is in contact with the arm guide surface 79.

Even when the push lever 44 is driven to the striking enabling position as illustrated in FIG. 17 under this state, the push lever 44 does not come in contact with the trigger arm 76, and a driving operation of a fastener does not be performed.

The present invention is not limited to the above embodiment, and various changes can be made without departing from the spirit of the invention. For example, the illustrated fastener driving tool 10 is used for driving the nail N into the workpiece W; however, the present invention can also be applied to a fastener driving tool using a staple as a fastener.

EXPLANATION OF REFERENCE CHARACTERS

11 . . . handle, 12 . . . main case, 13 . . . cylinder, 14 . . . main piston, 15 . . . driver blade, 21 . . . pressure chamber for driving, 22 . . . pressure chamber for return, 31 . . . pressure accumulation chamber, 33 . . . sleeve valve, 35 . . . valve drive chamber, 36 . . . air supply and exhaust flow passage, 41 . . . trigger, 44 . . . push lever, 47 . . . push member, 48 . . . connecting member, 51 . . . trigger valve, 53 . . . piston case, 54 . . . opening part, 55 . . . exhaust port, 56 . . . communication port, 61 . . . valve piston, 62 . . . seal member for air-supply shutoff, 63 . . . seal member for exhaust shutoff, 64 . . . sliding piston part, 66 . . . pressure chamber, 67 . . . plunger, 68, 69 . . . through hole, 72 . . . seal member for communication shutoff, 73 . . . seal member for exhaust switching, 76 . . . trigger arm, 79 . . . arm guide surface

The invention claimed is:

1. A fastener driving tool comprising:

a cylinder to which a main piston including a driver blade is mounted such that the main piston can axially reciprocate; and a sleeve valve driven between a position where compressed air in a pressure accumulation chamber is supplied to the main piston and a position where supply of the compressed air is stopped, by the compressed air supplied to a valve drive chamber, the fastener driving tool further comprising:

a piston case provided with an opening part communicating with the pressure accumulation chamber, an exhaust port communicating with outside, and a communication port communicating with the valve drive chamber;

a hollow valve piston mounted in the piston case so as to be movable between 1) an air-supply position where the valve piston causes the opening part and the communication port to communicate with each other and blocks the exhaust port, and 2) an exhaust position where the valve piston blocks the opening part and causes the exhaust port and the communication port to communicate with each other;

a sliding piston part provided at the valve piston and partitioning a pressure chamber in the piston case, the pressure chamber applying a thrust force in a direction toward the air-supply position to the valve piston;

a plunger mounted to the valve piston so as to be movable between 1) a communication position where the compressed air in the pressure accumulation chamber is supplied to the pressure chamber, and 2) a shutoff position where communication between the pressure accumulation chamber and the pressure chamber is shut off and air in the pressure chamber is exhausted;

a trigger operated between a striking enabling position and a striking stop position, the striking stop position being a position not operated by a worker;

a push lever driven to a striking enabling position when the push lever is brought into contact with a workpiece, and driven to a striking stop position when the push lever separates from the workpiece; and a trigger arm swingably mounted to the trigger and positioning the plunger to the communication position when the trigger and the push lever are in the striking stop positions, wherein, when the trigger is operated to the striking enabling position from the striking stop position after the push lever is operated to the striking enabling position while 1) the plunger is in the communication position and 2) the valve piston is in the air-supply position, the plunger is driven from the communication position to the shutoff position by the trigger arm to drive the valve piston to the exhaust position and to strike the driver blade, and wherein even when the trigger is released to the striking stop position from the striking enabling position while the valve piston is in the exhaust position and the push lever is in the striking enabling position, the valve piston keeps the exhaust position by keeping the plunger in the shutoff position.

2. The fastener driving tool according to claim 1, wherein, when the push lever is returned to the striking stop position while the valve piston is driven to the exhaust position and the trigger is held in the striking enabling position, the valve piston is driven to the air-supply position by driving the plunger to the communication position.

3. The fastener driving tool according to claim 1, wherein, even when the trigger is operated to the striking enabling position while the valve piston is in the air-supply position, the valve piston is held in the air-supply position by keeping the plunger in the communication position.

4. The fastener driving tool according to claim 1, wherein, when the push lever is returned to the striking stop position under a state in which the valve piston is driven to the exhaust position and the trigger is driven to the striking enabling position, the valve piston is switched to the air-supply position by switching the plunger to the communication position.

5. The fastener driving tool according to claim 1, wherein the valve piston includes a seal member for air-supply shutoff configured to open and close the opening part, and a seal member for exhaust shutoff configured to open and close the exhaust port.

6. The fastener driving tool according to claim 1, wherein the plunger includes a seal member for communication shutoff configured to open and close communication between the pressure accumulation chamber and the pressure chamber, and a seal member for exhaust switching configured to open and close communication between the pressure chamber and outside.

* * * * *